US008276608B2

(12) United States Patent
Vasconi

(10) Patent No.: US 8,276,608 B2
(45) Date of Patent: Oct. 2, 2012

(54) DEVICE FOR SECURING THE VALVES OF FIRE POSTS USING THE CONTROL TUBE

(76) Inventor: Bertrand Vasconi, Saint Martin les Boulogne (FR)

( * ) Notice: Subject to any disclaimer, the term of this patent is extended or adjusted under 35 U.S.C. 154(b) by 548 days.

(21) Appl. No.: 12/524,635

(22) PCT Filed: Jan. 9, 2008

(86) PCT No.: PCT/FR2008/050042

§ 371 (c)(1),
(2), (4) Date: Sep. 25, 2009

(87) PCT Pub. No.: WO2008/099103

PCT Pub. Date: Aug. 21, 2008

(65) Prior Publication Data

US 2010/0065133 A1 Mar. 18, 2010

(30) Foreign Application Priority Data

Jan. 26, 2007 (FR) ..... 07 52898

(51) Int. Cl.
*E03B 9/02* (2006.01)

(52) U.S. Cl. ..... 137/299; 137/296

(58) Field of Classification Search ..... 137/299, 137/296, 272
See application file for complete search history.

(56) References Cited

U.S. PATENT DOCUMENTS

| | | | | |
|---|---|---|---|---|
| 2,083,319 | A * | 6/1937 | Daviet | 137/299 |
| 2,627,277 | A * | 2/1953 | Martin | 137/299 |
| 3,914,966 | A | 10/1975 | Bello | |
| 3,939,861 | A * | 2/1976 | Thompson | 137/299 |
| 4,280,525 | A | 7/1981 | Byrnes | |
| 6,058,957 | A | 5/2000 | Honigsbaum | |
| 6,112,761 | A | 9/2000 | Scotto | |
| 6,901,950 | B1 | 6/2005 | Burt et al. | |

FOREIGN PATENT DOCUMENTS

| | | |
|---|---|---|
| FR | 2 740 849 | 5/1997 |
| WO | 03/049810 | 6/2003 |

OTHER PUBLICATIONS

International Search Report dated Sep. 17, 2008, from corresponding PCT application.

* cited by examiner

*Primary Examiner* — Kevin Lee
(74) *Attorney, Agent, or Firm* — Young & Thompson

(57) ABSTRACT

The invention relates to a device for securing a fire hydrant, comprising a duct (3), a control pipe (4) having an operation end piece (5) at one end and a valve (7) at the other end capable of supplying said duct (3) with water from the main network, at least one connection (8) attached to said duct and capable of receiving fire hoses, said connection (8) including a sealing plug (9), said plug (9) including at least one first retaining means (15, 15*a*, 15*b*) capable of interacting with the control pipe (4) or with a wall of said duct (3) so as to prevent the sinking of the plug into said connection, characterized in that said plug (9) includes at least a second retaining means (13) for preventing the extraction of the plug from said connection and actuated by a locking device (12).

20 Claims, 4 Drawing Sheets

DEVICE FOR SECURING THE VALVES OF FIRE POSTS USING THE CONTROL TUBE

BACKGROUND OF THE INVENTION

1. Field of the Invention

The field of this invention is that of firefighting means and in particular water supply terminals, such as fire posts and fire hydrants, combined under the generic term of hydrants.

2. Description of the Related Art

A fire post is, as its name indicates, a hollow post in which a set of controls is arranged and which allows the channeling of pressurized water from the primary supply network to the firefighting personnel. The post is equipped with valves to which the firefighters come to connect their hoses, which are sealed by plugs when they are not in use. Using a wheel, fixed or movable, or a key that is fitted to a maneuvering end fitting, the controls make it possible to move the check mechanism of a spigot, referred to as a valve, which is placed downstream from the pipe for channeling the water and whose opening causes the water to be made available. The post very often is enclosed in a hood that is equipped with a door that has a lock to keep water from being tapped off without authorization.

A fire hydrant differs slightly from a post in that it is completely integrated in the ground so as to be less visible, but it remains almost identical in its operation; namely, it uses a valve for connecting the hoses of the firefighters and a maneuvering end fitting, on which a key is fitted to activate the valve and to allow the water that is obtained from the primary network to flow.

Each post, like each hydrant, is always preceded upstream, just before its connection to the pipe that comes from the water supply network, by a "keyed hydrant." The latter, so called through improper use of language, is actually an isolating spigot that makes it possible to isolate the hydrant from the primary network. For this purpose, it is advisable to insert a suitable key in the top of the keyed hydrant, to pass through the elongated tube that extends it, to reach and to maneuver the isolating spigot.

The problem that communities frequently encounter is the theft of water by diversion of water from these hydrants. Various solutions have been proposed, which aim either at preventing the rotation of the control tube of the valve or at preventing access to the valves of the connections of the hoses. In the first case, this very often involves locks or loads placed on the control nut of the tube or on its maneuvering handle. In the second case, this involves loads placed on the valve and held by a lock. None of these solutions is actually effective because in general, these devices are positioned outside of the hydrant and are therefore exposed to all sorts of damage, whereby the latter can range from detachment or pure and simple destruction of the lock and/or the load.

SUMMARY OF THE INVENTION

This invention has as its object to eliminate these drawbacks by proposing a locking device that is positioned inside the post or the hydrant so as to prevent access to the water, even in the event of voluntary or accidental deterioration of the plug. The device interacts for this purpose with the control tube of the valve so as to prevent the extraction of the plug whether this is toward the outside or toward the inside of the hydrant.

For this purpose, the invention has as its object a device for securing a fire hydrant that comprises a pipe, a control tube equipped at one end with a maneuvering end fitting and at the other end with a valve that can allow the supply of said pipe with water from the primary network, at least one valve attached to said pipe and able to accommodate fire-extinguishing hoses, whereby said valve comprises a sealing plug, said plug supporting at least one first holding means that can work with said control tube or with a wall of said pipe so as to prevent the plug from sinking into said valve, characterized in that said plug also supports at least one second holding means that is designed to prevent the extraction of said plug from said valve, activated by a locking device.

This cooperation prevents someone of malicious intent from gaining access to the water while the plug deteriorates and is sunk inside the pipe.

Advantageously, at least one second holding means is used when it is locked inside said pipe.

This makes it possible to ensure the impossibility of extracting the plug from the valve in the absence of the key, even if the latter has deteriorated.

Preferably, for a fire post, said at least one first holding means is able to be separated from the shaft of the plug to be positioned laterally relative to the control tube and is able to draw near to said tube under the action of a locking device so as to radially lock, in locking position, said plug relative to said control tube.

This variant makes it possible, by itself, to prevent both the extraction and the sinking of the plug, without the bolts of a lock being needed to ensure this first function.

In one particular embodiment, the control tube supports at least one part with which said at least one first holding means works.

In addition to the protection of the plug against sinking, this second embodiment makes it possible to prevent the rotation of the control tube by locking a part that is attached to it laterally.

Preferably, said part that is connected to said control tube forms at least one stud that extends beyond said tube and in which at least one first holding means rests on said at least one stud.

This configuration can be used for the leveling of existing fire posts, after the piercing of the control tube from the valve in question and the insertion of a rod that is calibrated in length or the implantation of a stud in the form of a buffer.

Advantageously for a fire post, at least one first holding means is able to be separated from the shaft of the plug to be positioned laterally relative to the control tube and is able to draw near to said tube under the action of a locking device so as, in the locked position, to keep said at least one connected part from rotating in both directions.

Prevention of rotation in both directions from a single part is thus achieved.

Preferably, said at least one first holding means is a ring-shaped pallet in which at least one stud that is supported by said connected part engages.

Alternatively, said at least one first holding means is a palette that has the shape of a scooped-out cone in which at least one stud that is supported by said connected part engages.

In a preferred embodiment for a fire post, said plug has the shape of a scooped-out cylinder in its upper part so as to form two lateral appendices that are separated from one another by a hollow part whose bottom constitutes the first holding means.

This shape makes it possible to clamp the control tube so as to ensure the centering of the plug and, secondarily, to prevent its rotation around the axis of symmetry of the cylinder.

Advantageously, said plug is able to be inserted completely within the valve so as not to interfere with the installation of a cover on the hooking device of the cylindrical part of said valve.

This configuration makes it easy to install the invention in order to level existing fire posts.

BRIEF DESCRIPTION OF THE DRAWING FIGURES

The invention will be better understood, and other objects, details, characteristics and advantages of the latter will emerge more clearly during the following detailed explanatory description of several embodiments of the invention that are provided by way of purely illustrative and nonlimiting examples, referring to the accompanying diagrammatic drawings.

DETAILED DESCRIPTION OF THE INVENTION

Figure 1A:
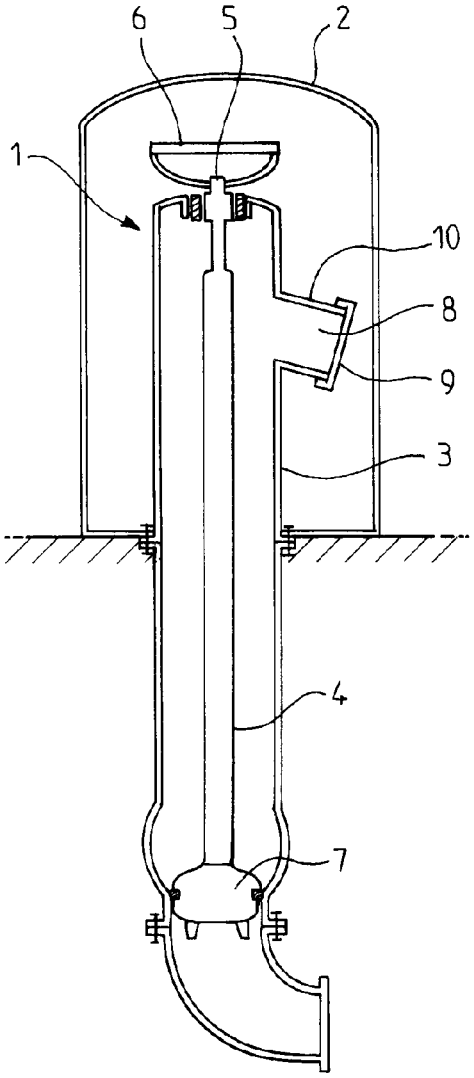
FIG. 1 is a cutaway view of a fire post (1*a*) and a fire hydrant (1*b*) according to the prior art.

With reference to FIG. 1*a*, a fire post is seen that comprises a body 1 whose upper part is enclosed in a covering 2. This body is essentially formed by an approximately vertical pipe 3, a first part of which, in the case of the fire post, is concealed in the ground and a second part is out of the ground. This pipe supports a control tube 4 whose upper end has the shape of a male maneuvering end fitting 5, onto which a fixed or movable control handle 6 is attached. At the lower end, the control tube supports a valve 7 that forms a spigot for releasing water from the primary supply network.

The pipe 3 is attached at its lower part to the water intake pipe from the primary network and forms, at the valve 7, a seat for the sealing joint of the latter. In its upper part, the pipe 3 empties into one or more valves 8 (in general three for a fire post, one for a hydrant), to which the hoses of the firefighters are attached. The valves have a cylindrical part 10 that separates in an essentially radial way, in the case of a fire post, from the pipe 3 and ends by a hooking device for a plug 9 that ensures sealing when the valve is not used.

Figure 1B:
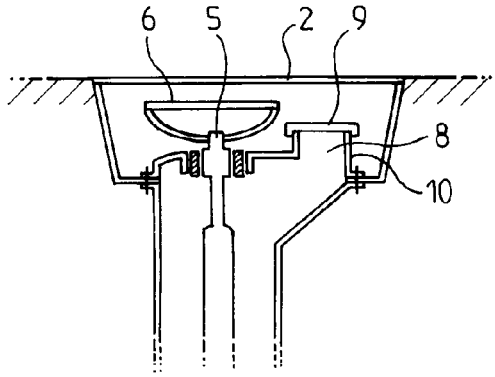

In FIG. 1*b*, the situation is analogous for the fire hydrant, whereby the same references designate the same elements.

Figure 3:
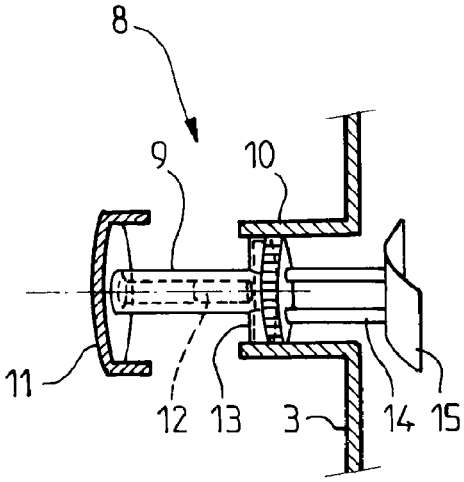
FIG. 3 is a diagrammatic perspective view of a plug for a fire post, according to a first embodiment of the invention, in unlocked position.
Figure 2:
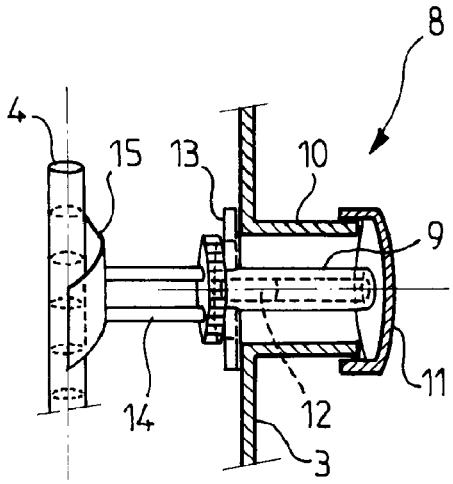
FIG. 2 is a diagrammatic cutaway view of a plug for a fire post according to a first embodiment of the invention, in the locked position.

With reference to FIGS. 2 and 3, a plug 9 for a fire post is seen according to a first embodiment of the invention that comprises a cover 11 that can be attached to the hooking device of the cylindrical part 10 of the valve 8. This plug supports a set of elements that are designed to penetrate the interior of the valve 8 so as to prevent its detachment or its sinking. First of all, a locking device 12 such as a lock that can be activated by a key (not shown) that controls bolts 13 that can firstly be separated from the shaft of the plug to prevent the removal of the plug and can secondly be retracted from the inside of said plug to release it from the valve is attached to this plug. These bolts are positioned here so that they are used in a locked position inside the pipe 3. The plug 9 also supports, beyond these bolts, a support 14 that extends in the direction of the control tube 4. A palette 15, which essentially rests on the control tube 4 when the plug is locked on the valve 8, is attached to this support. FIG. 3 shows the same elements when the plug is unlocked and when it is in the process of being removed from the valve 8.

In a variant of the invention, which achieves a better securing of the hydrant, the support 14 is made in two parts 14*a* and 14*b*. These two parts 14*a* and 14*b* support two palettes 15*a* and 15*b* that can be separated from the shaft of the plug once they have penetrated inside the pipe 3; they can then, once the plug 9 has been installed, be brought toward one another, under the action of, for example, the key of the locking device 12, so as to clamp the control tube 4. The shape of these two palettes 15*a* and 15*b* is such that they can, once closed again, enclose the control tube between them and even, if the support is strong enough, prevent the rotation of the latter. In this variant, the bolts 13 are not needed (or kept for the sake of redundancy) since the palettes 15*a* and 15*b* prevent, by themselves, both the extraction of the plug and its expulsion inside the pipe 3.

Figure 4:
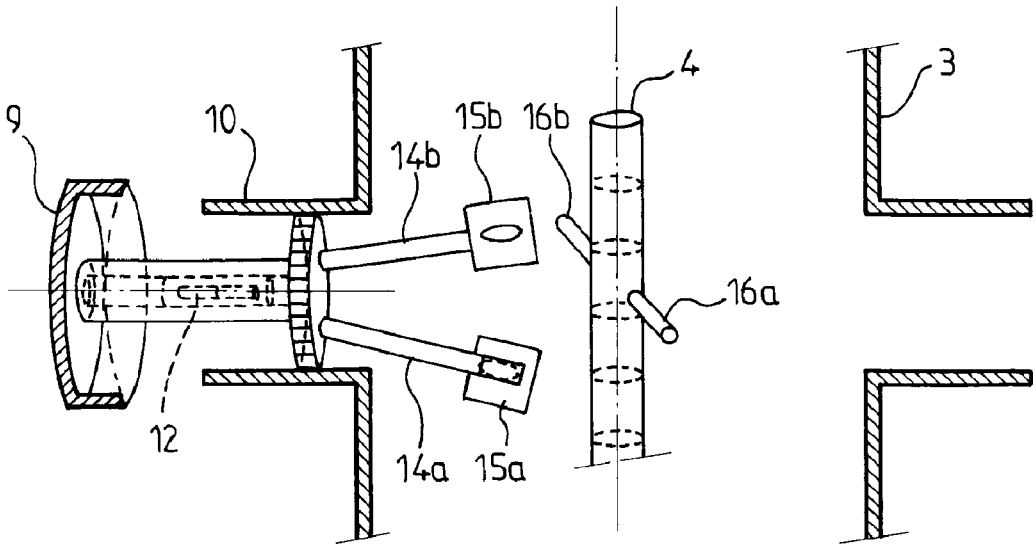
FIG. 4 is a diagrammatic perspective view of a plug for a fire post, according to a second embodiment of the invention, in unlocked position.

With reference to FIG. 4, a second embodiment will now be described. The elements of the post and the plug that are identical to the first embodiment are designated by the same reference number and are not described again. The plug also has a lock, equipped, if necessary, with bolts 13 (not shown in FIG. 4) as in the first embodiment, for the purpose of preventing the extraction of the plug. Here, the control plug 4 is radially pierced by a rod 16 whose two studs 16*a* and 16*b* project inside the pipe 3. The support 14 is made of two parts 14*a* and 14*b* that end by palettes 15*a* and 15*b* that are able to rest on the studs 16*a* and 16 so as to prevent the rotation of the control tube 4 when the plug is in place.

In a variant of this second embodiment, which also achieves better securing of the hydrant, the parts 14*a* and 14*b* can be separated from the shaft of the plug once they have penetrated inside the pipe 3; they can then, once the plug 9 has been installed, be brought toward one another under the action of, for example, the key of the lock 12, so as to enclose the two studs 16*a* and 16*b*. In this variant, the palettes 15*a* and 15*b* have a shape that is suitable for enclosing the studs, such as that of a ring or a scooped-out cone. Just as above, in this variant, the bolts 13 are not needed (or kept for the sake of redundancy), whereby their function to prevent the extraction of the plug is already ensured by the palettes 15*a* and 15*b*.

Figure 5:
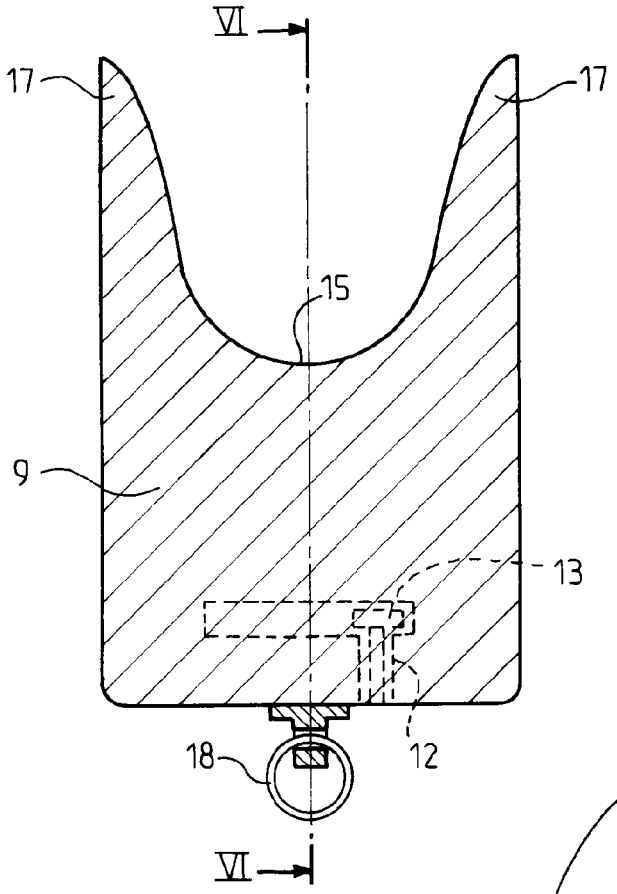
FIGS. 5 and 6 are front and profile cutaway views of a plug for a fire post according to a third embodiment of the invention.
Figure 6:
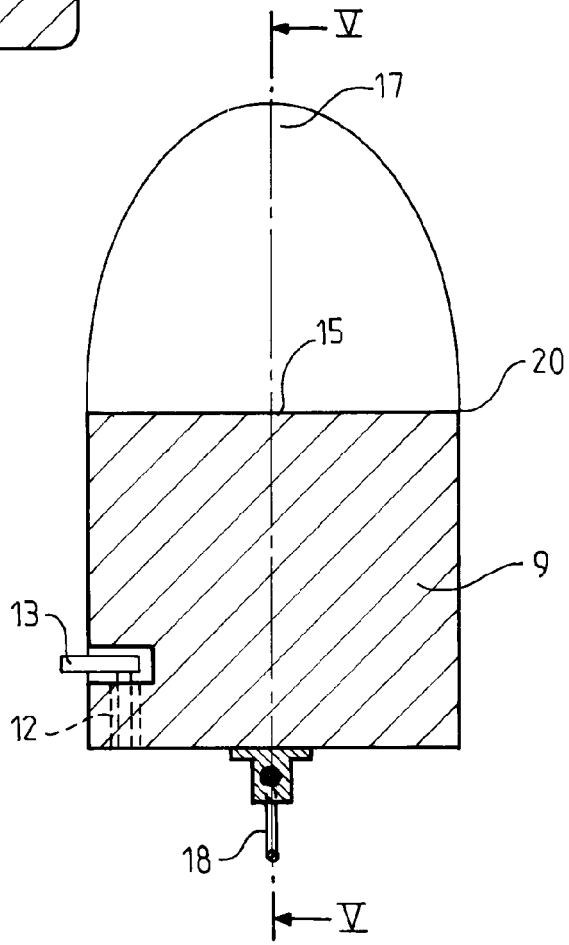
Figure 7:
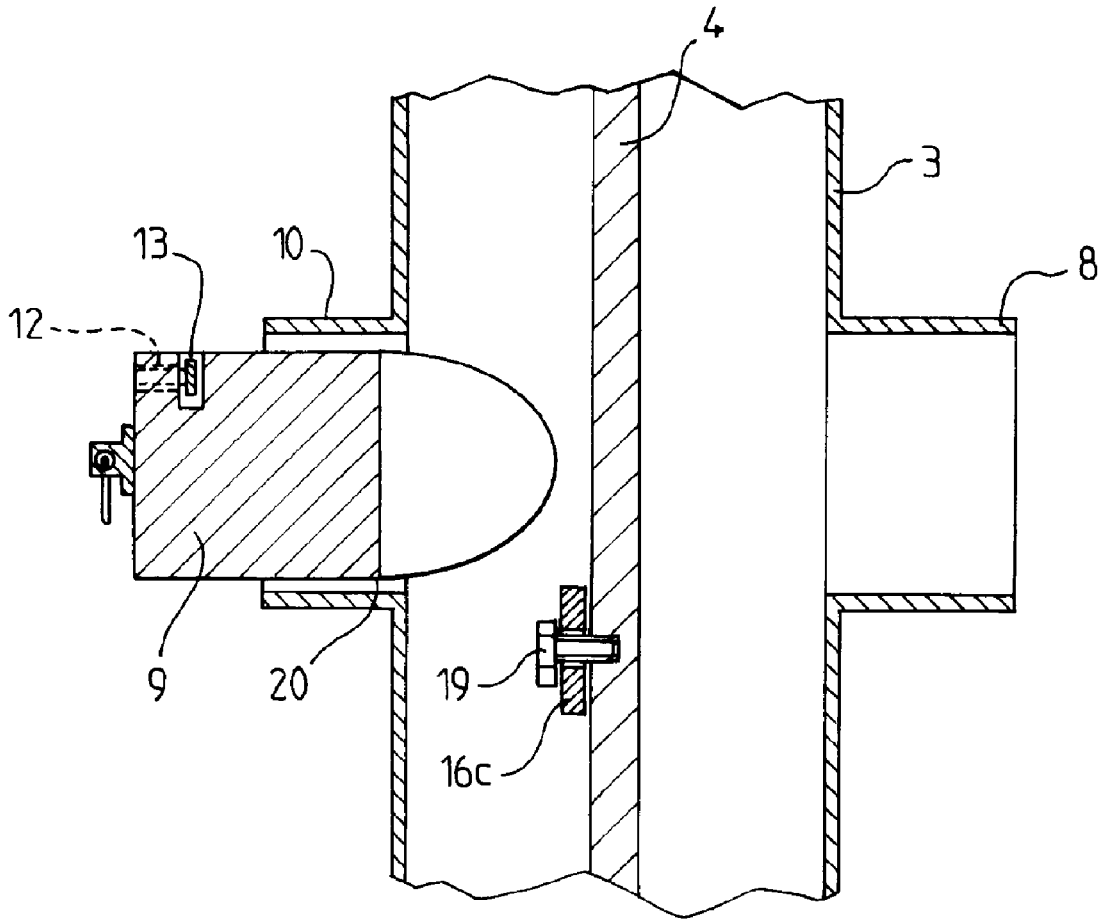
FIG. 7 is a profile cutaway view of a plug according to the third embodiment, during insertion into the valve.

With reference to FIGS. 5 to 7, a third embodiment of the invention will now be described. This embodiment is particularly well suited to the leveling of the existing installations since it requires only a tapping of the control tube and the installation of a buffer on the latter, and it does not provide a modification of the valve. The attachment of the buffer is shown in the figure by means of a screwing but could equally possibly be done by clamping or by gluing.

The plug 9 has a cylindrical shape whose upper part is scooped out for forming two lateral appendices 17 that are separated from one another by a hollow part whose bottom constitutes the palette 15 that is designed to rest on the control tube 4 and to prevent the sinking of the plug into the valve. The two appendices 17 have the function of clamping the control tube 4 so as to ensure the centering of the plug and, secondarily, preventing its rotation around the axis of symmetry of the cylinder.

On the cylindrical part of the plug that is placed beside the end that is opposite the appendices 17, there is the bolt 13 that is activated by a lock 12 that is accessible from the lower surface of the plug, i.e., the surface that is opposite the scooped-out part. On this same surface, a device 18 for extracting the plug from the valve also appears. The bolt 13 is positioned on the cylinder at a distance from the lower surface, such that after the plug is inserted into the valve 8 and rests on the control tube 4 of the bottom 15 of the hollow part, it is inside the pipe 3, and it can be maneuvered to rest on the inside surface of the pipe and thus keep the plug from being extracted from the valve.

In this third configuration, the control tube 4 supports a stud 16*c* that has the form of a buffer that extends approximately vertically along the control tube and is positioned relative to the plug 9. It is attached to the control tube via an attachment means such as a screw that engages in a threaded hole in the tube and is positioned on the tube at a height such that when the plug 9 is installed, its lower part is placed just above the stud 16*c*. During an attempt at opening the valve 7 by rotating the control handle 6, the control tube is locked in its ascension through the stud 16*c* that abuts against the body of the cylindrical plug 9 at the junction edge 20 of the hollow part with the cylindrical part.

In this third configuration as it appears in FIGS. 5 to 7, the plug does not support a cover as in the preceding configurations. However, since the latter is integrated completely inside the water valve 8, it is possible to reuse the cover 11 of the current hydrants to ensure the protection of the valve against external damage.

The operation of a securing device according to the first embodiment will now be described. The operation of the device according to the second and third embodiments is analogous.

The installation of a plug is carried out in a completely conventional way with the introduction of the palette 15, the support 14 and the lock 12 inside the cylindrical part 10 of the valve 8. Once the cover 11 of the plug comes against the cylindrical part 10, it is attached there in a known way such as, for example, by a rotation that creates the necessary support on the cylindrical part to ensure the sealing of the plug. The lock 12 is then activated by the key that deploys the bolts 13 inside the pipe 3 and thus prevents the removal of the plug from the valve.

In the event of an attempted break-in, assuming that access to the opening mechanism of the valve 7 has been left open or that it was able to be forced, the thief tries to unscrew the plug to gain access to the water. He will run into the locking system created by the bolts 13 that prevent the plug from being withdrawn from the valve 8 and thus unscrewed. He can then attempt to cut the cover 11 of the plug 9 for the purpose of retracting the latter inside the vertical column and thus gaining access to the valve 8 and being able to attach a hose there. The palette, however, then moves in the direction of the control tube 4 and very quickly takes up the optional residual play that exists between these two elements. As soon as the palette 15 rests on the control tube 4, it prevents the plug from being inserted any further forward toward the interior. Therefore, even if the thief can open the valve 7, he cannot gain access to the water without using the key of the lock 12.

In the case of the variants that are mentioned above for the first two embodiments, the bolt 13 does not exist (or exists to ensure a redundancy), and the two parts of the support 14 can move laterally. The two parts 14*a* and 14*b* are first of all closed to be able to enter the cylindrical part 10 of the valve 8. When the palettes 15*a* and 15*b* have gone beyond the inside wall of the pipe 3, these palettes are separated, for example, under the action of a spring or by a particular action on the key, so as to let the control tube 4 as well as, in the second embodiment, the studs 16*a* and 16*b*, pass between them. The locking action by the key of the lock 12 causes the parts 14*a* and 14*b* to pull together and thereby causes the control tube 4 in the first embodiment and the studs 16*a* and 16*b* in the second embodiment to be enclosed by the palettes 15*a* and 15*b*.

The configurations that are described above apply on a priority basis to the valves of fire posts. With the necessary changes being made, they also apply, for some of them, to fire hydrant valves by replacing the cooperation of the second holding means with the control tube 4 by a cooperation of these same means with a wall of the pipe 3.

Although the invention has been described in relation to several particular embodiments, it is quite obvious that it is in no way limited and that it comprises all of the technical equivalents of the means that are described as well as their combinations if the latter fall within the scope of the invention.

The invention claimed is:

1. A device for securing a fire hydrant that comprises:

a pipe (3);

a control tube (4) that is equipped at one end with a maneuvering end fitting (5) and at the other end with a valve (7) that can allow the supply of said pipe (3) with water from a primary network; and at least one valve (8) that is attached to said pipe and is able to accommodate fire-extinguishing hoses, said valve (8) comprising a sealing plug (9), said plug (9) supporting at least one first means for holding (15, 15*a*, 15*b*) configured to enclose said control tube (4) or penetrate inside said pipe (3) so as to prevent said plug from sinking into said valve, wherein said plug (9) also supports at least one second means for holding (13) that is designed to prevent the extraction of said plug from said valve, activated by a locking device (12).

2. The device according to claim 1, wherein said at least one second means for holding (13) is used when the device is locked inside said pipe (3).

3. The device according to claim 1, wherein said at least one first means for holding (15*a*, 15*b*) is able to be separated from a shaft of the plug (9) to be positioned laterally relative to the control tube (4) and is able to draw near to said tube under the action of a locking device (12) so as, in a locked position, to keep said plug radially locked relative to said control tube.

4. The device according to claim 1, wherein the control tube (4) supports at least one part (16, 16*a*, 16*b*, 16*c*) with which said at least one first means for holding (15, 15*a*, 15*b*) works.

5. The device according to claim 4, wherein said part (16) that is connected to said control tube forms at least one stud (16*a*, 16*b*, 16*c*) that extends beyond said tube and wherein said at least one first means for holding (15*a*, 15*b*) rests on said at least one stud.

6. The device according to claim 4, wherein said at least one first means for holding (15*a*, 15*b*) is able to be separated from the shaft of the plug (9) to be positioned laterally relative to the control tube (4) and able to draw near to said tube under the action of a locking device (12) so as, in a locked position, to keep said at least one connected part (16*a*, 16*b*, 16*c*) from rotating in both directions.

7. The device according to claim 6, wherein said at least one first means for holding (15*a*, 15*b*) is a ring-shaped palette in which at least one stud (16*a*, 16*b*) that is supported by said connected part (16) engages.

8. The device according to claim 6, wherein said at least one first means for holding is a palette (15*a*, 15*b*) that has a shape of a scooped-out cone in which at least one stud (16*a*, 16*b*) that is supported by said connected part (16) engages.

9. The device according to claim 4, wherein said plug (9) has a shape of a scooped-out cylinder in its upper part so as to form two lateral appendices (17) that are separated from one another by a hollow part whose bottom constitutes the first holding means (15).

10. The device according to claim 9, wherein said plug (9) is able to be inserted completely within the valve (8) so as not to interfere with the installation of a cover (11) on the hooking device of the cylindrical part (10) of said valve (8).

11. The device according to claim 2, wherein said at least one first means for holding (15*a*, 15*b*) is able to be separated from the shaft of the plug (9) to be positioned laterally relative to the control tube (4) and is able to draw near to said tube under the action of a locking device (12) so as, in a locked position, to keep said plug radially locked relative to said control tube.

12. The device according to claim 5, wherein said at least one first holding means (15*a*, 15*b*) is able to be separated from the shaft of the plug (9) to be positioned laterally relative to the control tube (4) and able to draw near to said tube under the action of a locking device (12) so as, in a locked position, to keep said at least one connected part (16*a*, 16*b*, 16*c*) from rotating in both directions.

13. The device according to claim 5, wherein said plug (9) has the shape of a scooped-out cylinder in its upper part so as to form two lateral appendices (17) that are separated from one another by a hollow part whose bottom constitutes the first means for holding (15).

14. A device for securing a fire hydrant that comprises:

a pipe (3);

a control tube (4) that is equipped at one end with a maneuvering end fitting (5) and at the other end with a valve (7) that can allow the supply of said pipe (3) with water from a primary network; and at least one valve (8) that is attached to said pipe and is able to accommodate fire-extinguishing hoses, said valve (8) comprising a sealing plug (9), said plug (9) supporting at least one first palette (15, 15*a*, 15*b*) configured to enclose said control tube (4) or penetrate inside said pipe (3) so as to prevent said plug from sinking into said valve, wherein said plug (9) also supports at least one second palette (13) that is designed to prevent the extraction of said plug from said valve, activated by a locking device (12).

15. The device according to claim 14, wherein said at least one second palette (13) is used when the device is locked inside said pipe (3).

16. The device according to claim 14, wherein said at least one first palette (15*a*, 15*b*) is able to be separated from a shaft of the plug (9) to be positioned laterally relative to the control tube (4) and is able to draw near to said tube under the action of a locking device (12) so as, in a locked position, to keep said plug radially locked relative to said control tube.

17. The device according to claim 14, wherein the control tube (4) supports at least one part (16, 16*a*, 16*b*, 16*c*) with which said at least one first palette (15, 15*a*, 15*b*) works.

18. The device according to claim 17, wherein said part (16) that is connected to said control tube forms at least one stud (16*a*, 16*b*, 16*c*) that extends beyond said tube and wherein said at least one first palette (15*a*, 15*b*) rests on said at least one stud.

19. The device according to claim 17, wherein said at least one palette (15*a*, 15*b*) is able to be separated from the shaft of the plug (9) to be positioned laterally relative to the control tube (4) and able to draw near to said tube under the action of a locking device (12) so as, in a locked position, to keep said at least one connected part (16*a*, 16*b*, 16*c*) from rotating in both directions.

20. The device according to claim 19, wherein said at least one palette (15*a*, 15*b*) is a ring-shaped palette in which at least one stud (16*a*, 16*b*) that is supported by said connected part (16) engages.

* * * * *